US006053375A

United States Patent [19]

Schwartz et al.

[11] Patent Number: 6,053,375

[45] Date of Patent: Apr. 25, 2000

[54] NON-RESEALABLE, SNAP-FITTED CLOSURE

[75] Inventors: John Joseph Schwartz, Cincinnati, Ohio; Reuben Earl Oder, Union, Ky.; James Pyott Johnston, Merchtem, Belgium; Adam Ross Nichols, Cincinnati, Ohio

[73] Assignee: The Procter & Gamble Company, Cincinnati, Ohio

[21] Appl. No.: 09/179,309

[22] Filed: Oct. 27, 1998

[51] Int. Cl.[7] ..... B65D 47/08

[52] U.S. Cl. ..... 222/567; 222/147; 222/547; 222/562; 215/14; 215/28; 215/263

[58] Field of Search ..... 222/147, 544, 222/547, 562, 566, 567, 570, 573; 215/14, 26, 28, 29, 263

[56] References Cited

U.S. PATENT DOCUMENTS

| | | | |
|---|---|---|---|
| 4,494,682 | 1/1985 | Beckstrom et al. | 222/570 |
| 4,600,131 | 7/1986 | Roof et al. | 222/547 |
| 5,188,249 | 2/1993 | Cargile | 222/570 |
| 5,320,260 | 6/1994 | Song et al. | 222/547 |
| 5,454,489 | 10/1995 | Vesborg | 222/547 |
| 5,738,232 | 4/1998 | Roberts et al. | 222/562 |
| 5,743,437 | 4/1998 | Moore et al. | 222/147 |

FOREIGN PATENT DOCUMENTS 19652148 6/1998 Germany .

*Primary Examiner*—J. Casimer Jacyna
*Attorney, Agent, or Firm*—James C. Vago; Elizabeth M. Koch

[57] ABSTRACT

A non-resealable, snap-fitted closure comprises a closure, a drop ring and a container. The closure has a sleeve with a sleeve snap. The drop ring has an internal snap and an external snap wherein the internal snap engages the sleeve snap of the closure when the closure engages the drop ring. The container has a neck and a neck snap, wherein the neck snap and the internal snap of the drop ring engage when the closure and the drop ring engage the neck. The neck snap of the neck and the internal snap of the drop ring are an order of magnitude stronger than the sleeve snap of the sleeve and the external snap of the drop ring. When the closure is removed from the neck, the drop ring remains attached to the neck and is free to move vertically up and down along the neck, thereby preventing reattachment of the closure to the container.

5 Claims, 3 Drawing Sheets

NON-RESEALABLE, SNAP-FITTED CLOSURE

FIELD OF THE INVENTION

The present invention relates to container closures, and more particularly, a non-resealable, snap-fitted closure which prevents the closure from being resealed after removal.

BACKGROUND OF THE INVENTION

Current formulations for household cleaners and other compositions have an added benefit of generating a gas when mixed with water, thereby increasing their cleaning ability. Typically, this off-gassing is inconsequential since water is not introduced into the formulation until after the cleaner is dispensed from the original package. However, many users rinse the inside of the container to get any residual product out for the final use. This is generally not a problem because most products do not produce a gas when contacted with water.

In the case of cleaning products that off-gas on contact with water, rinsing the interior of the container or attempting to thin the cleaner for additional usage by the user can be an issue. There is no significant problem as long as the product is rinsed out of the container and used immediately. However, the problem arises when the user fills the container with water to soak the residual product off the inner walls for an extended period of time or simply adds water to increase the amount of product in an effort to be more economical. In these cases, the closure is reattached to the container to prevent spilling. This reapplication of the closure presents the ultimate problem in that pressure is able to build over time in the resealed container resulting in the package bulging. When the user reopens the package, a rapid de-pressurization can occur, causing product to be expelled, potentially resulting in injury or at a minimum, significant mess.

To further compound the issue, many of the current attempts to solve this problem have been ineffective and often confuse the user. In systems where the container is intended to be opened for repeated use, the package would be rendered non-functional as the user would be able to add water to the container but not be able to reattach the closure. In this case, both the product and the package would be non-functional.

Other systems exist that prevent pressure from building within the container and allow the closure to be reattached. However, these systems also allow water to be introduced within the container and the package resealed. In these systems, the product is rendered virtually unusable although the package is functional. Therefore, the user is unaware that the product and package have not been used as intended, and more importantly, that the product has reacted with the water and become ineffective. When the user then tries to use the product, it will not perform as intended.

These existing solutions typically have one of two shortcomings: 1) the system utilizes a thread or snap feature that allows the package to be opened and resealed numerous times with little degradation to the thread or snap feature, or 2) the system incorporates a breakaway feature that destroys the engagement between the closure and bottle. These are most evident in tamper proof systems incorporating break bands or tear bands. Both systems convey immediate removal of the closure instead of removal at the end of life.

In addition, traditional venting systems are ineffective to handle the larger amounts of internal pressure generated by the off-gassing of the newer types of cleaning formulation. These systems prevent the internal build-up of pressure within the container without allowing the product to leak from the package. They also include delayed venting systems that incorporate a vent which is exposed when the user begins to open the package, thereby allowing pressure to release in a controlled manner as the package is being opened. However, these systems are only effective for small amounts of pressure build-up and also allow the water to be introduced into the package without any indication to the user that the product should be used immediately. Again, this results in the cleaning product reacting with the water and becoming unusable.

Therefore, what is needed is a non-resealable, snap-fitted container closure which enables the product to off-gas but which can not be resealed after removal.

THE SUMMARY OF THE INVENTION

A non-resealable, snap-fined closure comprises a closure having a sleeve with a sleeve snap, a drop ring having an internal snap and an external snap wherein the internal snap engages the sleeve snap of the closure when the closure snappingly engages the drop ring and a container having a neck and a neck snap, wherein the neck snap and the internal snap of the drop ring engage when the closure and the drop ring snappingly engage the neck, the neck snap of the neck and the internal snap of the drop ring are an order of magnitude stronger than the sleeve snap of the sleeve and the external snap of the drop ring, whereby when the closure is removed from the neck, the drop ring remains attached to the neck and is free to move vertically up and down along the neck, thereby preventing reattachment of the closure to the container.

DETAILED DESCRIPTION OF THE INVENTION

Figure 1:
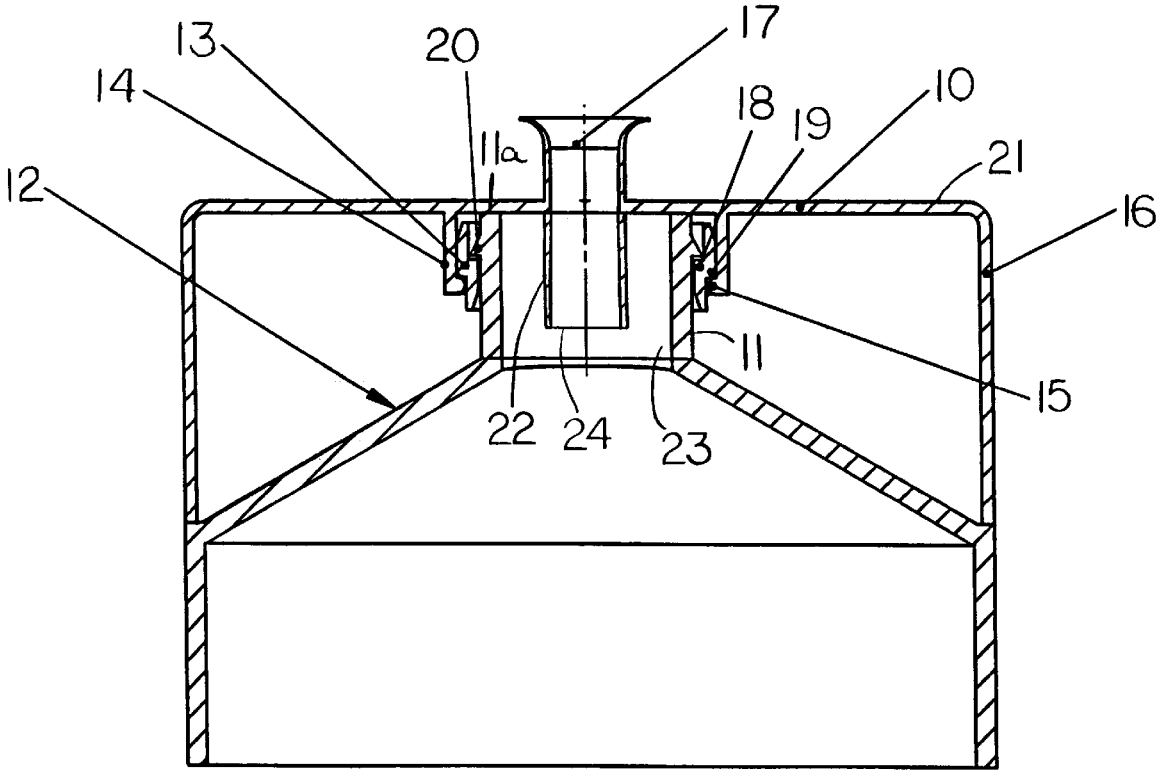
FIG. 1 is a cross-sectional view of the preferred closure, drop ring and container assembly in the preferred embodiment of the present invention.

Referring to FIG. 1, a non-resealable, snap-fitted closure 10 is attached to a neck 11 of a container 12 using a drop ring 13 in the preferred assembled state. The closure 10 is preferably injection molded and has, in its preferred embodiment, an inner sleeve 14 with a internal sleeve snap 15 and an outer wall 16 which provides an aesthetic shape that conceals the engagement of the neck 11, container 12 and drop ring 13. The preferred closure also has an integral spout 17 for dispensing product and may have an overcap (not shown) to seal the spout 17 during shipping and use. The spout 17 may comprise a conventional push/pull cap as is well known in the liquid detergent art without deviating from the intent of the invention.

The preferred drop ring 13 is an injection molded ring with an internal drop ring snap 18 and external drop ring snap 19. The internal snap 18 securingly engages an external neck snap 20 of the neck 11, while the external snap 19 securingly engages the internal snap 15 of the closure 10. The preferred neck 11 is blow molded but, as with the closure 10, may be formed in a variety of ways and may comprise a variety of materials without deviating from the intent of the invention.

To assemble the closure 10 to the neck 11 of the container 12 via the drop ring 13, the closure 10 and drop ring 13 are first snappingly engaged using sleeve snap 15 and external 19, respectively. Specifically, the sleeve snap 15 of the closure 10 snappingly engages the external snap 19 of the drop ring 13. Afterwards, the closure 10 and the drop ring 13 are assembled to the neck 11 by snappingly engaging the internal drop ring snap 18 of the drop ring 13 with the external neck snap 20 of the neck 11. The closure 10 is then un-resealably secured to the neck 11 of the container 12 via the drop ring 13.

The closure 10 further comprises a hood 21 which covers the sealing engagement of the container 12, the drop ring 13, and the sleeve 14. In this way, the engagement of the closure to the container is not visible and the user is not tempted to remove the closure 10 prior to emptying the product from the container 12. More importantly, there is no clear means to add water to the container 12 as the closure 10 appears to be permanently attached to the container 12.

After sealing engagement of the closure 10 with the container 12 and the drop ring 13 as shown in FIG. 1, the closure 10 may not be reapplied to the neck 11 sufficient to recreate the seal. Therefore, the invention allows for the closure 10 to be removed only once by the user. The un-resealability of the closure 10 is obvious to the user only after removal of the closure and conveys to them that the container 12 is ready for disposal.

The closure 10 also has a dip tube 22 which extends from the spout 17 within the neck 11 of the container 12. The need for the dip tube 22 is created by the separation of the liquid product within the container 12 into two different phases over the product life. The neck 11 creates a reservoir 23 for the undesirable top product separation layer (approximately 15%) to collect while the dip tube 22 enables the desirable bottom product separation layer of the liquid product to be properly dispensed from the container 12. In this way, the undesirable product separation is not dispensed in the initial use but instead collects in the reservoir 23 and is prevented from escaping through the spout 17 by the dip tube 22. Thus, the undesirable product separation is portioned over multiple doses so that the product separation is not obvious to the user and product performance is not reduced. The amount of separation liquid contained within the reservoir 23 is determined by the size of the reservoir 23 and can be modified depending on the parameters of the particular liquid product without deviating from the intent of the invention.

When the closure 10 and container 12 assembly is inverted, the undesirable liquid separation will fill the reservoir 23 as this liquid is typically less viscous than the desirable liquid separation. The undesirable product separation fill be contained within the reservoir until it reaches the open end 24 of the dip tube 22 when it will flow through the dip tube 22 and out of the spout 17. However, by the time that the undesirable top product separation layer fills the reservoir 23, it must compete with the remaining homogeneous product which will also dispense through the spout 17. Since this top separation layer is initially caught in the reservoir, it is portioned out over several doses and is also mixed back into the original product. Thus, the dip tube 22 minimizes the appearance of the non-homogeneous product (i.e., top separation layer. The dip tube 22 diameter and length (along with the closure 10 and container 12 geometry) can be defined to form a specified hang-up volume that correlates to the amount of product that separates from the original product. Furthermore, the diameter of the dip tube 22 may vary and is not limited to the spout 17 size. In addition, the length of the dip tube 22 may also be variable depending on the hang-up volume desired. Although the preferred embodiment is a straight circular tube 22, it is not limited to this shape.

Figure 2A:
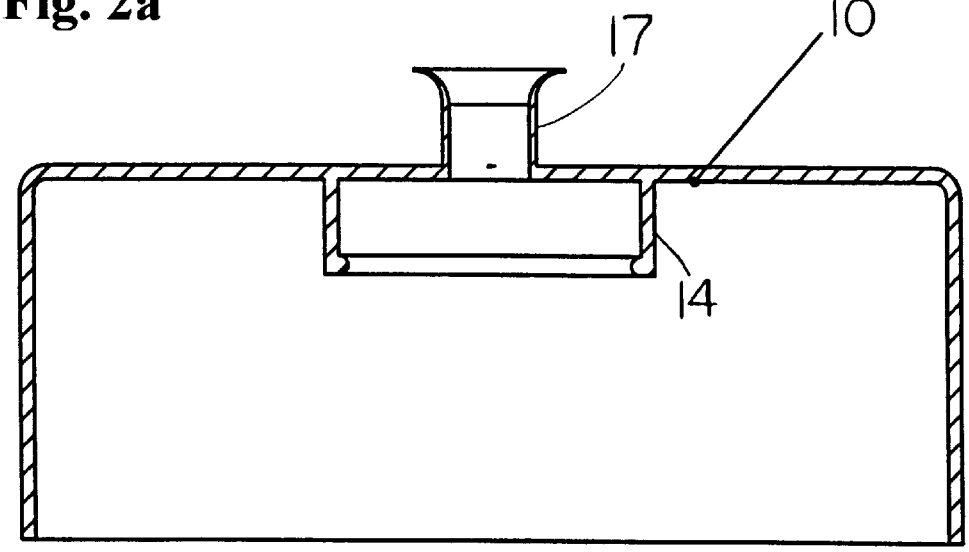
FIG. 2*a* and 2*b* is a cross-sectional view of the preferred closure, drop ring and container assembly after removal of the closure in the preferred embodiment of the present invention.
Figure 2B:
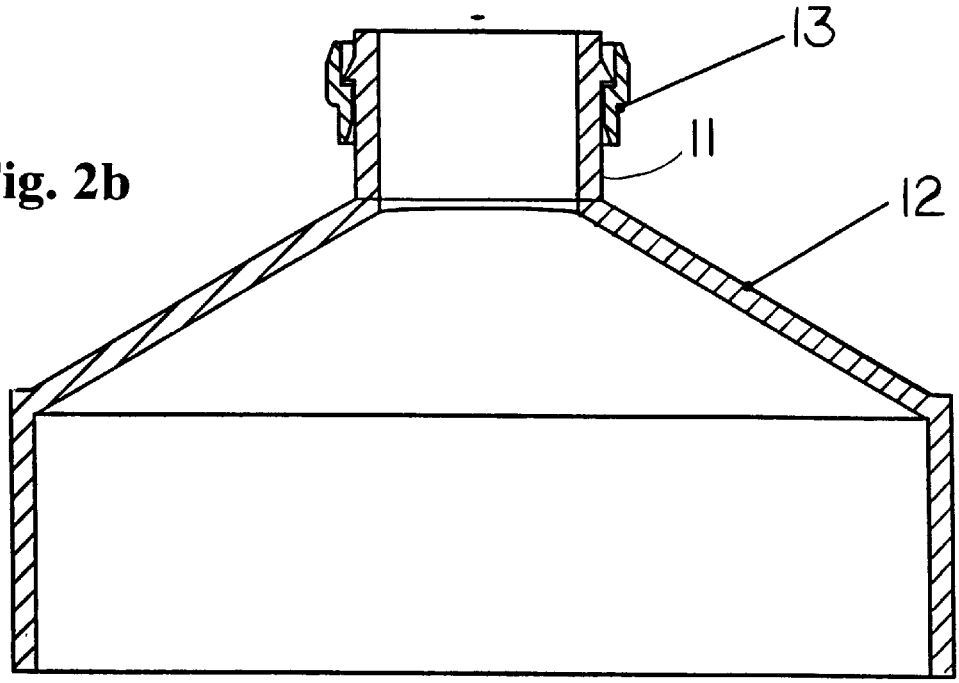

Referring to FIGS. 2*a* and 2*b*, upon removal of the closure 10 from the container 12, the drop ring 13 remains with the neck 11. This is due to the internal snap 18 of the drop ring 13 and the neck snap 20 of the neck 11 being an order of magnitude stronger than the sleeve snap 15 of the inner sleeve 14 and the external snap 19 of the drop ring 13. Thus, the engagement of the snaps 18 and 20 is stronger than the engagement of the snaps 15 and 19 such that removal of the closure 10 results in the snaps 15 and 19 yielding before snaps 18 and 20 will yield.

Figure 3:
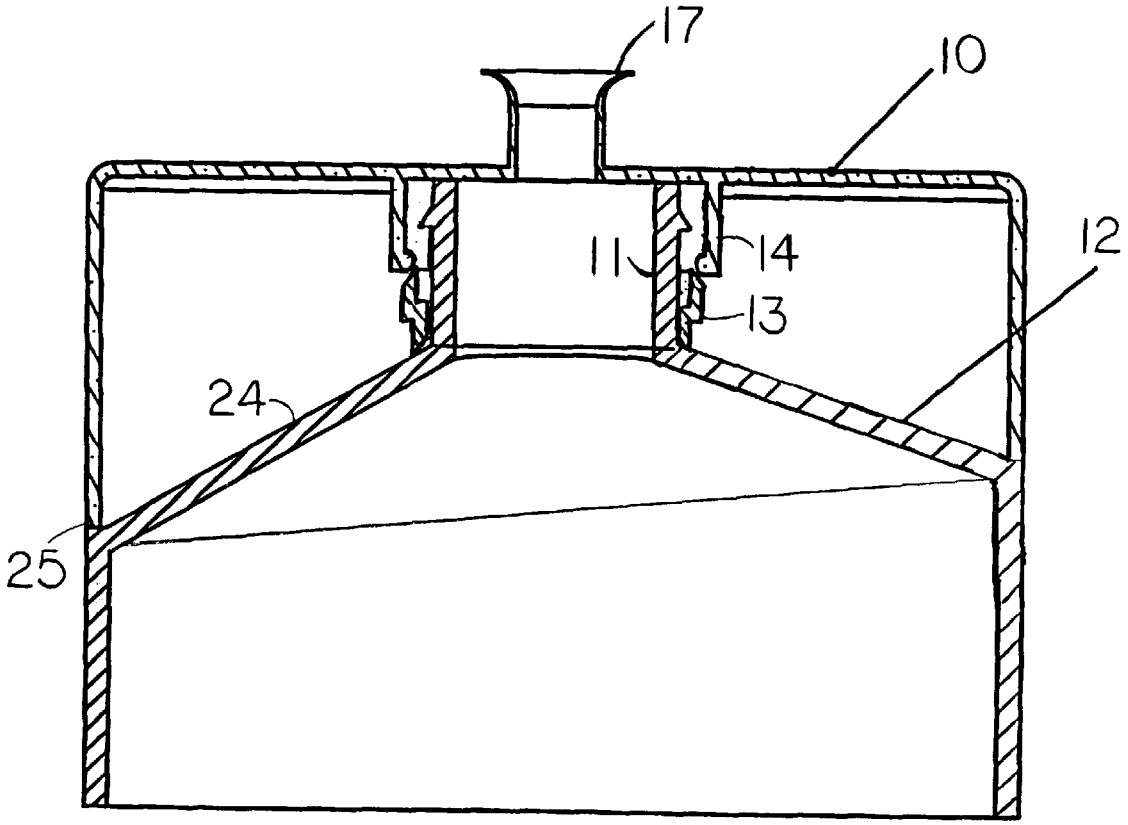
FIG. 3 is a cross-sectional view of the preferred closure, drop ring and container assembly upon reapplication of the closure after initial removal in the preferred embodiment of the present invention.

Referring to FIG. 3, removal of the closure 10 results in the now unrestricted drop ring 13 being free to move vertically down along the neck 11 of the container 12 due to gravity. When the drop ring 13 slides down along the neck 11, it is impossible to sealingly reapply the closure 10 onto the neck 11 which is due to the snaps 18 and 19 of the snap ring 13 moving out of the range of the closure 10. As a result, when the user attempts to reapply the closure 10, the closure 10 will rest on top 11*a* of the neck 11 but will not snap onto the drop ring 13 or the neck 11. This will signal the user that a catastrophic event has occurred and the package is not functional. This in turn conveys that the remainder of the product within the container 12 must be used and the container 12 discarded. Thus, the invention eliminates the reapplication of the closure 10 once it has been removed from the container 12. This reduces the probability of the user introducing water to the product and then later trying to use the destroyed product. It also eliminates the possibility of the user being injured due to an excessive off-gassing pressure build-up within the container 12 as in the prior art.

Preferably, as shown in FIG. 3, a top portion 24 of the container 12 is sloped along with the bottom 25 of the closure 10 such that removal of the closure 10 will create a camming action when the closure is rotated. In this way, the force of the sleeve 14 and drop ring 13 engagement is overcome and the closure 10 may be removed. The force to remove the closure is sufficient so as to discourage removal. However, the slope of the top 24 of the container 12 and the bottom 25 of the closure 10 enable the closures removal without significant effort.

While the embodiment of the invention shown and described is fully capable of achieving the results desired, it is to be understood that this embodiment has been shown and described for purposes of illustration only and not for purposes of limitation. Other variations in the form and details that occur to those skilled in the art and which are within the spirit and scope of the invention are not specifically addressed. Therefore, the invention is limited only by the appended claims.

What is claimed is:

1. A non-resealable, snap-fitted closure, comprising:

a closure having a sleeve with a sleeve snap;

a drop ring having an internal snap and an external snap wherein the external snap engages the sleeve snap of the closure when the closure snappingly engages the drop ring; and a container having a neck and a neck snap, wherein the neck snap and the internal snap of the drop ring engage when the closure and the drop ring snappingly engage the neck, the neck snap of the neck and the internal snap of the drop ring are an order of magnitude stronger than the sleeve snap of the sleeve and the external snap of the drop ring, whereby when the closure is removed from the neck, the drop ring remains attached to the neck and is free to move vertically up and down along the neck, thereby preventing reattachment of the closure to the container.

2. The closure of claim 1, wherein said closure has a hood which substantially covers said sleeve, said drop ring and said neck assembly.

3. The closure of claim 1, wherein said closure has an integral spout.

4. The closure of claim 1, wherein said closure has a dip tube, wherein said dip tube extends within a reservoir created within said neck of said container.

5. The closure of claim 1, wherein said container has a sloped top portion which engages a sloped bottom portion of said closure to create a camming action when said closure is rotated.

* * * * *